US006176435B1

(12) United States Patent
Nielsen

(10) Patent No.: US 6,176,435 B1
(45) Date of Patent: Jan. 23, 2001

(54) THERMALLY POWERED DIFFUSER

(76) Inventor: Marty Nielsen, P.O. Box 8250, Santa Rosa, CA (US) 95405

( * ) Notice: Under 35 U.S.C. 154(b), the term of this patent shall be extended for 0 days.

(21) Appl. No.: 09/339,887

(22) Filed: Jun. 25, 1999

Related U.S. Application Data

(60) Provisional application No. 60/090,766, filed on Jun. 26, 1998.

(51) Int. Cl.[7] ..... F24F 7/00

(52) U.S. Cl. ..... 236/49.5; 236/49.3; 236/DIG. 19; 454/258

(58) Field of Search ..... 236/49.5, 49.3, 236/1 C, 91 E, 99 E, DIG. 19; 454/258

(56) References Cited

U.S. PATENT DOCUMENTS

| | | | | |
|---|---|---|---|---|
| Re. 30,953 | * | 6/1982 | Vance et al. | 236/49 |
| 4,231,513 | * | 11/1980 | Vance et al. | 236/49 |
| 4,491,270 | * | 1/1985 | Brand | 236/49 |
| 4,509,678 | * | 4/1985 | Noll | 236/49 |
| 4,523,713 | * | 6/1985 | Kline et al. | 236/1 C |
| 5,647,532 | * | 7/1997 | De Villiers et al. | 236/49.5 |
| 5,673,851 | * | 10/1997 | Dozier et al. | 236/49.5 |
| 5,860,592 | * | 1/1999 | Dozier et al. | 236/49.3 |

* cited by examiner

*Primary Examiner*—William Doerrler
*Assistant Examiner*—Marc Norman
(74) *Attorney, Agent, or Firm*—Johnson & Stainbrook, LLP; Craig M. Stainbrook; Larry D. Johnson

(57) ABSTRACT

A thermally powered variable air volume diffuser is provided, comprising a diffuser housing and a thermally powered actuator assembly mounted therein which varies the size of a supply air discharge opening. The actuator assembly comprises four thermal actuators and means operatively connecting the thermal actuators to a flow control disc defining the discharge opening. The volume of air supplied to a room is varied in response to changes in air supply temperature and room temperature. In the heating cycle, the first thermal actuator lowers the flow control disc, causing increased supply air output. Heated air from the air supply duct causes the second thermal actuator to engage the third thermal actuator. As room temperature rises, the third thermal actuator pushes the second thermal actuator, raising the flow control disc and reducing supply air output. In the cooling mode the supply air is provided below a set temperature so that the first and second thermal actuators do not respond to actuate flow control disc movement, and only the fourth thermal actuator varies the supply air. As room air temperature rises, the fourth thermal actuator lowers the flow control disc. As the room cools, the fourth thermal actuator causes the opposite effect.

12 Claims, 5 Drawing Sheets

THERMALLY POWERED DIFFUSER

This Application claims benefit to provisional application Ser. No. 60/090,766 filed Jun. 26, 1998.

BACKGROUND OF THE INVENTION

1. Field of the Invention

The present invention relates to a thermally powered air diffuser and, more particularly, to a thermally powered variable air volume diffuser that regulates air volume delivery in response to air supply and room air temperature changes.

2. Description of the Prior Art

Numerous types of variable air volume (VAV) systems for controlling room air temperature are known and used, including fan-powered systems, VAV with radiation, VAV with reheat, heat-pump VAV, changeover/bypass VAV, and thermally powered VAV systems. Thermally powered systems typically employ air diffusers having "thermal motors" that open and close internal air flow dampers—so-called "smart diffusers." Thermally powered smart diffusers have several advantages over the equipment comprising other types of VAV systems, including: (1) having self-contained systems for controlling room air supply without the need for dedicated wall and duct thermostats or additional electrical wiring, pneumatic piping, added system pressures; (2) low maintenance requirements and costs; (3) excellent comfort control, due to the fact that temperature control set points may be adjusted at the diffuser itself to provide proportionally modulating control within a restricted temperature span for a particular room or space; (4) reliability, due to a minimum of mechanical components and the entire absence of electrical components; (5) flexibility, allowing walls and partitions to be moved and office space reconfigured without costly reconfiguration of HVAC systems; (6) energy and cost savings, because no energy input is required to drive the system other than that already supplied by the heating and air conditioning system; and (7) low manufacturing and installation costs.

Thermally actuated variable air volume diffusers are well-known in the art. Notable examples include Vance U.S. Pat. No. 4,231,513, issued Nov. 4, 1980, and reissued Jun. 1, 1982, which discloses a diffuser for a conditioned air system for buildings incorporating a self-contained and integrated sensor actuator control system for varying the volume flow of conditioned air through the diffuser in response to changes in room air temperature. The sensor actuator structure for sensing the room air temperature and for modulating the conditioned air flow is entirely contained within the diffuser structure and is powered directly by the changes in room air temperature without auxiliary equipment or power systems. Additionally, Vance teaches a second integrated sensor that measures the temperature of the duct air and provides the actuating force to changeover and convert the operation of the diffuser from a cooling mode to a heating mode, or vice versa.

Brand U.S. Pat. No. 4,491,270 teaches an improvement over Vance. Brand discloses a diffuser comprising four thermal sensor actuators, including a first sensor responsive to changes in the room air temperature when cool air is supplied through the duct into the room. A second thermal sensor actuator is responsive to the duct air and is adapted to engage the first thermal sensor actuator when cool air is supplied through the duct and to disengage the first thermal sensor actuator when warm air is supplied through the duct. A fourth thermal sensor actuator is responsive to changes in the duct air temperature and brings the third thermal sensor actuator into engagement when warm air is supplied through the duct and to disengage the third thermal sensor actuator when cool air is supplied through the duct.

Noll U.S. Pat. No. 4,509,678 discloses a room air diffuser control mechanism which is operated by two thermally powered thermostatic actuator elements, one reacting to the room air temperature and the other reacting to the supply air temperature. When the supply air temperature is cool (e.g., less than 68° F.), the supply air element is retracted and its linkage system rendered inoperative. The room air element, through its linkage system, reacts to control the room temperature by varying the area of an air diffusion discharge opening. When the supply air temperature is warm (e.g., greater than 78° F.), the supply air element reacts to disengage the room air element linkage system and to move the air diffusion discharge opening to an adjustable, predetermined position. In this mode, the room air element does not affect the discharge opening regardless of the temperature of the room air.

Kline et al. U.S. Pat. No. 4,523,713 also teaches an improvement over Vance. However, whereas Brand discloses a diffuser having four thermal sensor actuators, Kline et al teaches a diffuser having three thermal sensor actuators. The first thermal sensor actuator is responsive to changes in the room air temperature and is engaged when cool air is supplied through the duct into the room. A third thermal sensor actuator is responsive to changes in the room air temperature and is engaged when warm air is supplied to the room. A second thermal sensor actuator brings either the first or second thermal sensor actuator into engagement with the diffuser when the appropriate temperature of air is supplied through the duct and disengages the thermal actuator not being used with the duct air temperature.

SUMMARY OF THE INVENTION

A thermally powered variable air volume diffuser is provided, comprising a diffuser housing defining an cylindrical upper chamber having an air inlet and a diffused air outlet defined by the opening at the lower portion of the diffuser housing from which conditioned air is supplied and diffused into a room. The air inlet is connected to an air supply duct. The housing includes an air discharge opening proximate to the lower end of the cylindrical upper portion. The discharge opening regulates the volume of air passing through the diffuser.

A thermal actuator assembly is mounted inside the upper cylindrical chamber and has a U-shaped chassis with a transverse axle rotatably mounted through apertures in its vertical sections. A first thermal actuator is mounted to the chassis at a first bracket integral with the chassis. The first actuator has a hollow cap containing thermoactive material and an integral hollow threaded cylindrical stem extending from the cap and threadably mounted to the first bracket. A first movable shaft is surrounded by the cylindrical stem.

A U-arm is pivotally mounted on the transverse axle, one arm extending beyond the transverse axle and including a second bracket to which a second thermal actuator is mounted with a second integral threaded stem. The second thermal actuator houses a second movable shaft.

A third thermal actuator is mounted to the base portion of the chassis through a third bracket and is disposed below the chassis. The third thermal actuator, structured like the first and second actuators, further includes a hollow cylindrical post and movable shaft, each extending upwardly from the cap and threaded stem beyond the base of the chassis. The stem of the third thermal actuator is threadably received by a first isolator bushing.

A fourth thermal actuator extends below the chassis, mounted to the horizontal base portion of the chassis. This actuator includes a hollow cylindrical center post housing a fourth movable shaft. As with the third thermal actuator, the stem of this actuator is threadably received in a second isolator bushing. The cap may include radial fins to increase the actuator's thermal sensitivity.

A flow controller disc is slidably mounted on the fourth actuator center post. The flow controller disc has a brim and an interior conical damper. A lever assembly is fixed to the transverse axle at one end and to the flow controller disc at the other.

A first radial tab member is affixed to the transverse axle, which extends outwardly from the back side of the chassis. Means for imparting a clockwise rotational force to the transverse axle is attached to the first radial tab member and the chassis. Second and third radial tab members at attached to the transverse axle at its middle. Force means connect the second radial tab member and U-arm, imparting a clockwise force to the second radial tab member and a counterclockwise force to the U-arm when viewed from the front.

A center appearance panel is suspended below and affixed to the diffuser housing. An air induction channel is defined by a room air flow inducer disposed above the appearance panel.

The diffuser is powered and controlled entirely by the four thermostatic actuators. In the present invention movement of the lever assembly and the attached flow controller disc is actuated by rotation of the transverse axle and U-arm. Transverse axle and U-arm movement are actuated by the shaft movements of each of the actuators. As the flow controller disc rises and descends along center post in response to temperature changes, the discharge opening is also varied, thereby adjusting the volume of conditioned air entering the room.

When a heating cycle is initiated, the first thermal actuator will respond at a set temperature, e.g., 68° . The movable shaft extends to engage the third radial tab member and to rotate transverse axle and U-arm, taking pressure off lever assembly. The weight of flow control disc then causes the disc to descend.

Heated air from the air supply duct causes the second thermal actuator to react and engage the extended shaft of the third thermal actuator. As the room temperature rises, the movable shaft of the third thermal actuator pushes against the second thermal actuator, rotating U-arm clockwise and causing the lever assembly to raise the flow control disc.

In the cooling mode the supply air is provided below a set temperature, at and below which the movable shafts of the first and second thermal actuators are retracted. The fourth thermal actuator varies the supply air in this mode. A rise in room air temperature will cause the movable shaft of the fourth thermal actuator to engage the second radial tab member and rotate U-arm up from the lever assembly, thereby causing flow control disc to descend and the discharge opening to widen. As the room cools, the movable shaft of the fourth thermal actuator retracts to cause the opposite effect.

DETAILED DESCRIPTION OF A PREFERRED EMBODIMENT

Figure 1:
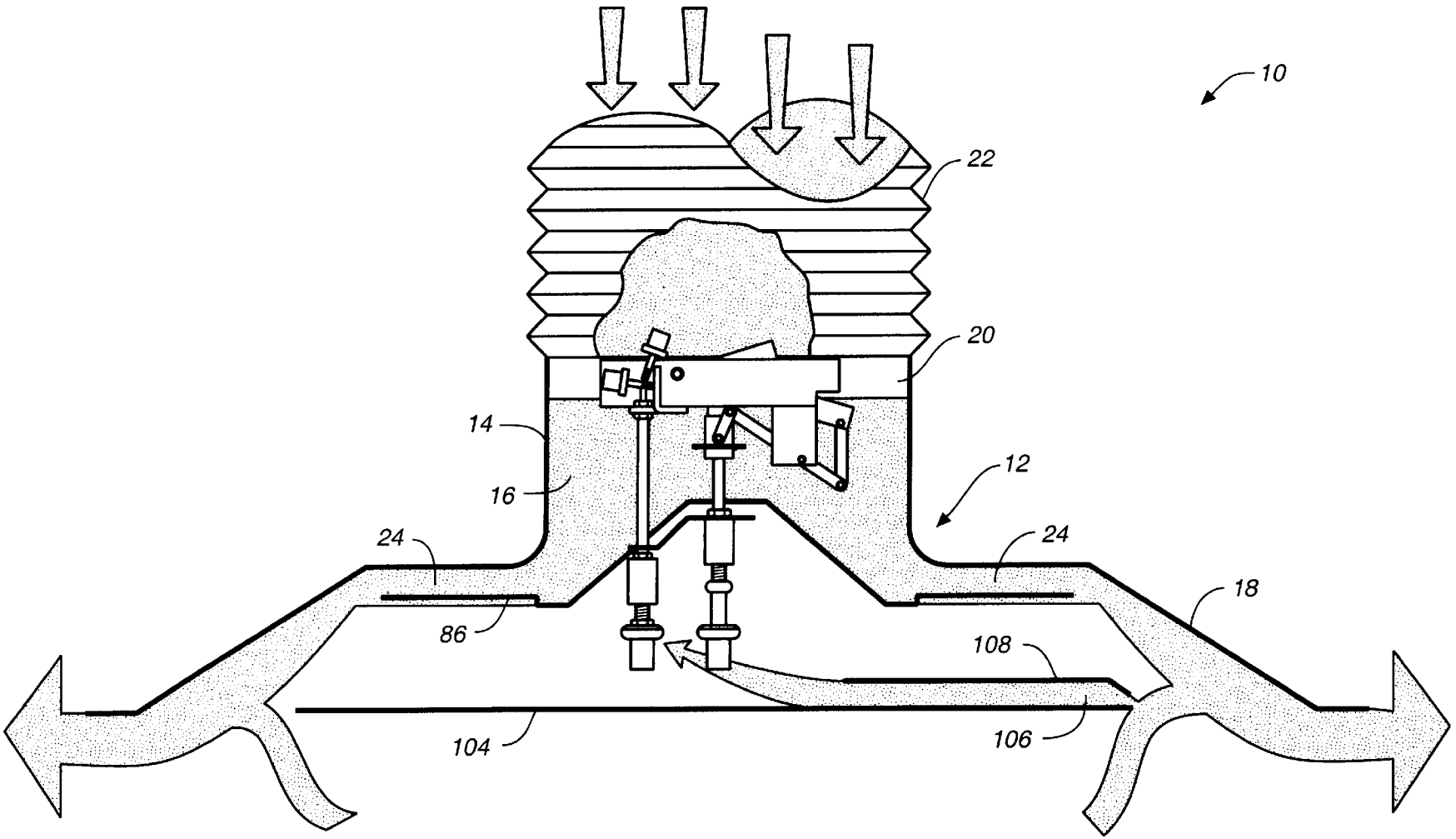
FIG. 1 is a side elevation, partial cut away view of the thermally powered VAV diffuser of the present invention.

FIG. 1, a side elevation partial cut away view of the thermally powered variable air volume diffuser of the present invention, and shows that the diffuser, generally denominated 10, comprises a diffuser housing 12 defining a generally cylindrical upper chamber 14 having an air inlet 16, and a diffused air outlet 18, defined by the opening at the lower portion of the diffuser housing, from which conditioned air is supplied and diffused into a room. The air inlet 16 is connected at its inlet collar 20 to an air supply duct 22. The housing 12 further comprises an air discharge opening 24 at the lower end of the cylindrical upper portion 14.

Figure 2:
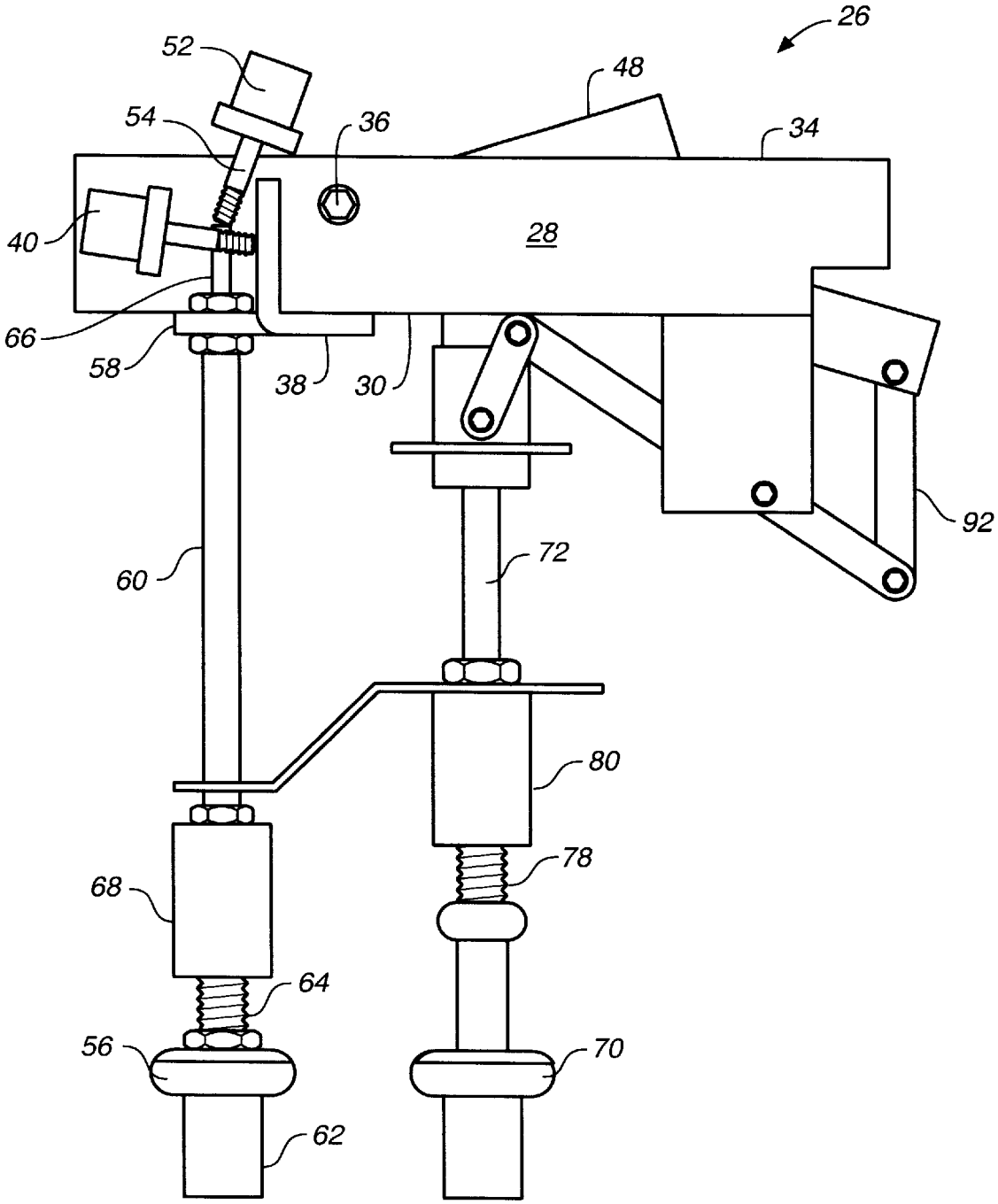
FIG. 2 is a side elevation view of the thermal sensor actuator assembly of the diffuser.
Figure 3:
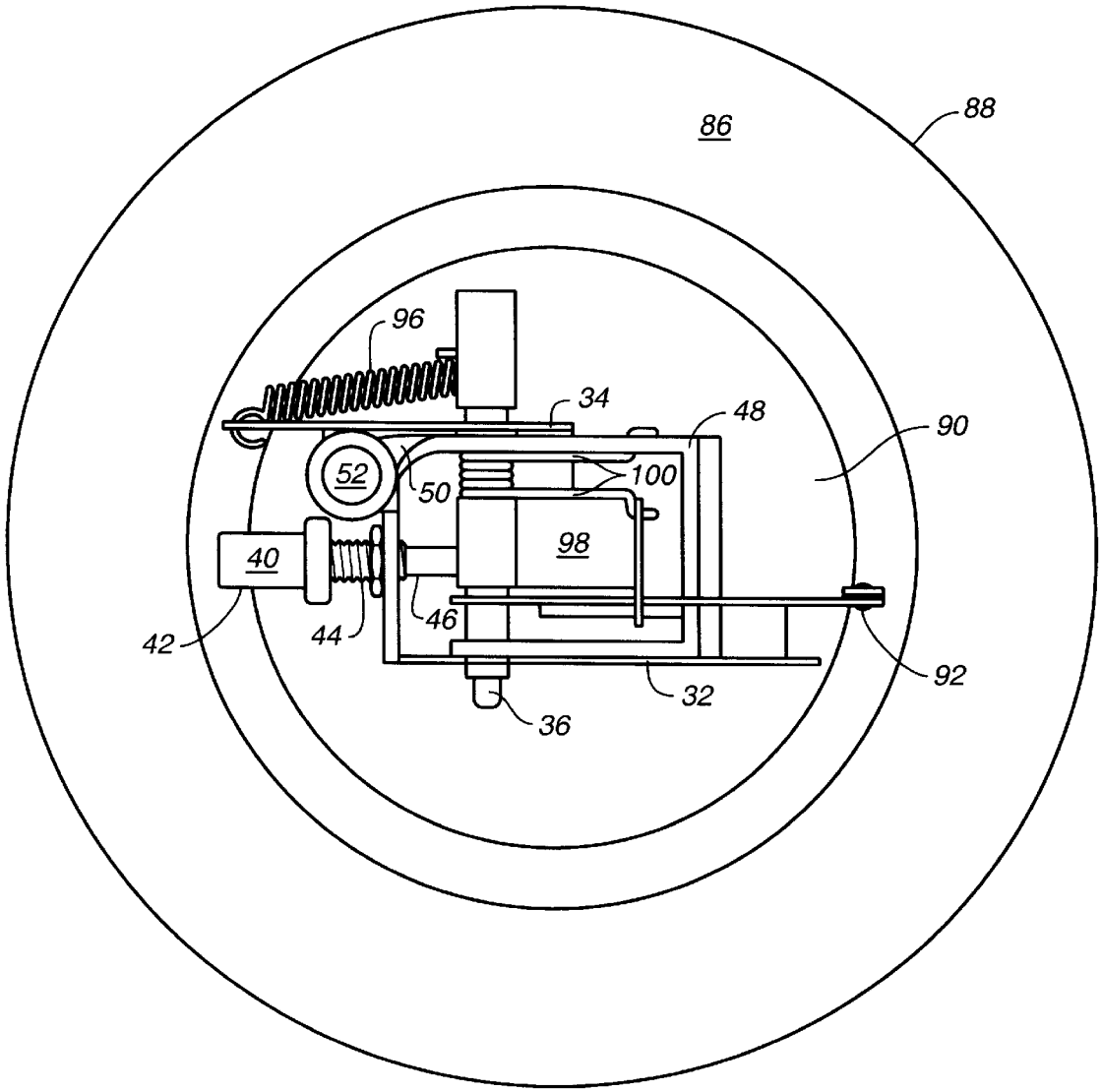
FIG. 3 is a top view of the diffuser as shown in FIG. 3.

Within the cylindrical upper portion 14 is an actuator assembly 26, mounted proximate to the air inlet collar 20. The actuator assembly is shown in an enlarged view in FIG. 2. FIG. 3 provides a top view of the diffuser of the present invention. The actuator assembly 26 has a generally U-shaped chassis 28 with a horizontal base portion 30, a first vertical section 32, and a second vertical section 34. Each of the vertical sections has a transverse aperture through which a transverse axle 36 is rotatably mounted.

Affixed to the horizontal base portion 30 of chassis 28 is a first bracket 34 and a first thermal actuator 40 having a cap 42 with a hollow cavity containing thermoactive material, and further having an integral hollow threaded cylindrical stem 44 extending from the cap and threadably mounted to the first bracket 38. A first movable shaft 46 is surrounded by the cylindrical stem.

Figure 4:
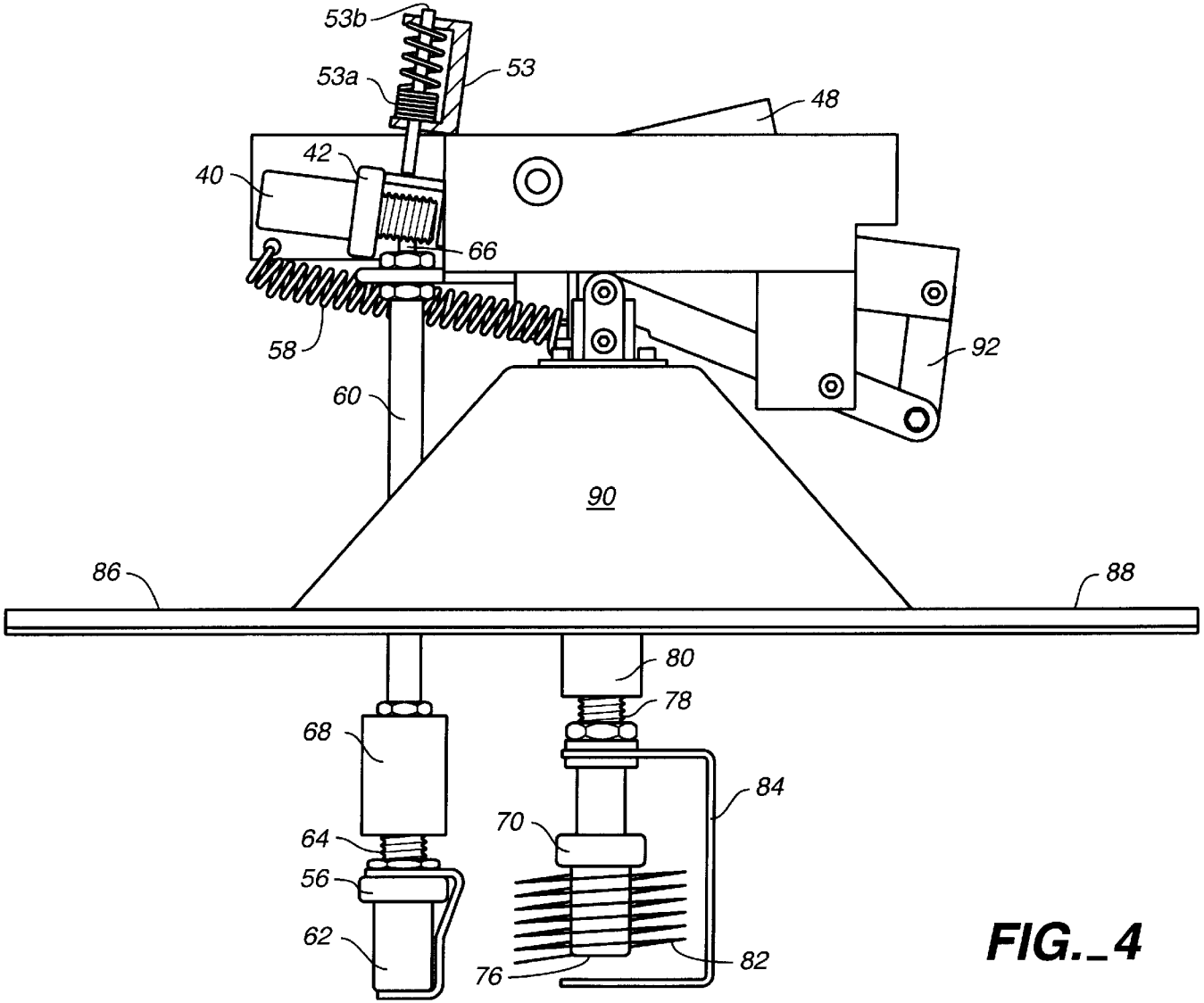
FIG. 4 is a side elevation view of the diffuser showing the flow control disc and actuator assembly in the cold room/cold air supply closed configuration.

A U-arm 48 having apertures at each of its arms is pivotally mounted on transverse axle 36. One arm cantilevers beyond the transverse axle and includes a second bracket 50 to which is mounted a second thermal actuator 52 via a second integral threaded stem 54 and in which is movably housed a second movable shaft, which remains interior to the threaded stem even in its most extended configuration and is not shown in the figures. Referring to FIG. 4, the second actuator may, alternatively, comprise a memory metal actuator 53 having a thermally responsive helical coil spring 53*a*, preferably fabricated from a nickel-titanium alloy of a composition tailored for temperature responsiveness, which spring is movably connected to said second movable shaft 53*b*.

A third thermal actuator 56 is disposed below chassis 28 and is mounted to the horizontal base portion 30 of the chassis 28, via a third bracket 58. The third thermal actuator includes a hollow cylindrical post 60, a cap 62, a third integral hollow threaded stem 64, a third movable shaft 66 [see FIG. 8] which extends beyond the end of the movable shaft, and a first isolator bushing 68 for threadably receiving stem 64. The third thermal actuator functions as the heating mode room temperature sensing.

A fourth thermal actuator 70 extends below chassis 28 and is mounted to the horizontal base portion of the chassis, either through a bracket or, alternatively, an opening in the horizontal base portion. This actuator has a hollow cylindrical center post 72, a fourth movable shaft 74, a cap 76, a fourth integral hollow threaded stem 78, and a second isolator bushing 80 for threadably receiving stem 78. Preferably the cap 74 includes circumferential outwardly projecting radial fins 82 to increase the thermal sensitivity and responsiveness of the actuator. An adjustment rod 84 provides for easy adjustment of the fourth actuator. This actuator functions as the cooling mode room temperature sensing actuator.

A flow controller disc 86 is slidably mounted on center post 72, said flow controller disc preferably having a brim 88 defining its perimeter and an interior conical damper portion 90. Preferably the upper surface of the brim is covered with a layer of foam for quiet operation. A lever assembly 92 is fixed to transverse axle 36 at one end and to flow controller disc 86 at the other.

Transverse axle 36 extends outwardly from the second vertical section 34 of chassis 28, and affixed to the transverse axle is a first radial tab member 94 (best seen in FIG. 5), to which is attached means for imparting a clockwise force to the transverse axle (when viewed from the front), such means preferably comprising a helical extension spring 96 attached to said first radial tab member 94 at one end and to the second vertical section 34 of the chassis 28 at the other. Affixed to the middle section of transverse axle, between the first and second vertical sections of the chassis, are a second radial tab member 98 (seen only in FIG. 3) and a third radial tab member 102 (seen only in FIG. 5). Force means connect the second radial tab member 92 and U-arm 48 so as to impart a clockwise force to the second radial tab member and a counterclockwise force to the U-arm when viewed from the front. Preferably such force means comprises a right hand torsion spring 100 biased against both U-arm 48 and second radial tab member 92.

Finally, a center appearance panel 104 is suspended below the housing 12 and affixed to the same, preferably by spring clips so that the actuator assembly can be easily adjusted. An air induction channel 106 is defined by a room air flow inducer 108 disposed above the appearance panel. In operation this diverts a small amount of supply air, which induces a room air sample through the induction channel across the third and fourth thermal actuators.

The diffuser of the present invention is powered and controlled entirely by the four thermostat actuators. Each of the thermal actuators work on the same principle, which is well known in the art. The thermal actuators contain thermoactive expansion material that dramatically increases and decreases in volume under temperature changes, and the volume changes translate thermal energy into linear mechanical force via the movement of a diaphragm-type element which pushes and pulls the movable shaft. Extension and retraction movements are caused by increases and decreases, respectively, in the volume of thermoactive material in the cap. In the present invention movement of the lever assembly and the attached flow controller disc is actuated by rotation of the transverse axle 36 and U-arm 48 which engages the lever assembly within certain temperature ranges. Both transverse axle and U-arm movement are actuated by the shaft movements of each of the actuators. As the flow controller disc rises and descends center post 72 in response to temperature changes, the discharge opening 24 is also varied, thereby adjusting the volume of conditioned air entering the room.

Referring now to FIG. 4, the diffuser is shown in the closed configuration. In this figure the actuator assembly is configured as it would be when the air duct or air supply is cool and the room temperature is also cool, such as would be the case in early morning before the system has begun a heating cycle to condition room air, or when operating in the cooling mode and supplying cool air to an already cool room. Flow controller disc 86 is fully elevated and defines the smallest discharge opening set by the user.

When a heating cycle is initiated, first thermal actuator 40 will respond at a set temperature, e.g., 68° . The first thermal actuator reacts to warm air and functions independently of the other three thermal actuators. During cooling it serves no purpose. At the set temperature the movable shaft 46 of first thermal actuator extends longitudinally to engage third radial tab member 102 and to slow and gently rotate transverse axle 36 and U-arm 48 counterclockwise, thus taking pressure off lever assembly 92. The weight of flow control disc 86 causes the disc to descend center post 72 in response.

Figure 5:
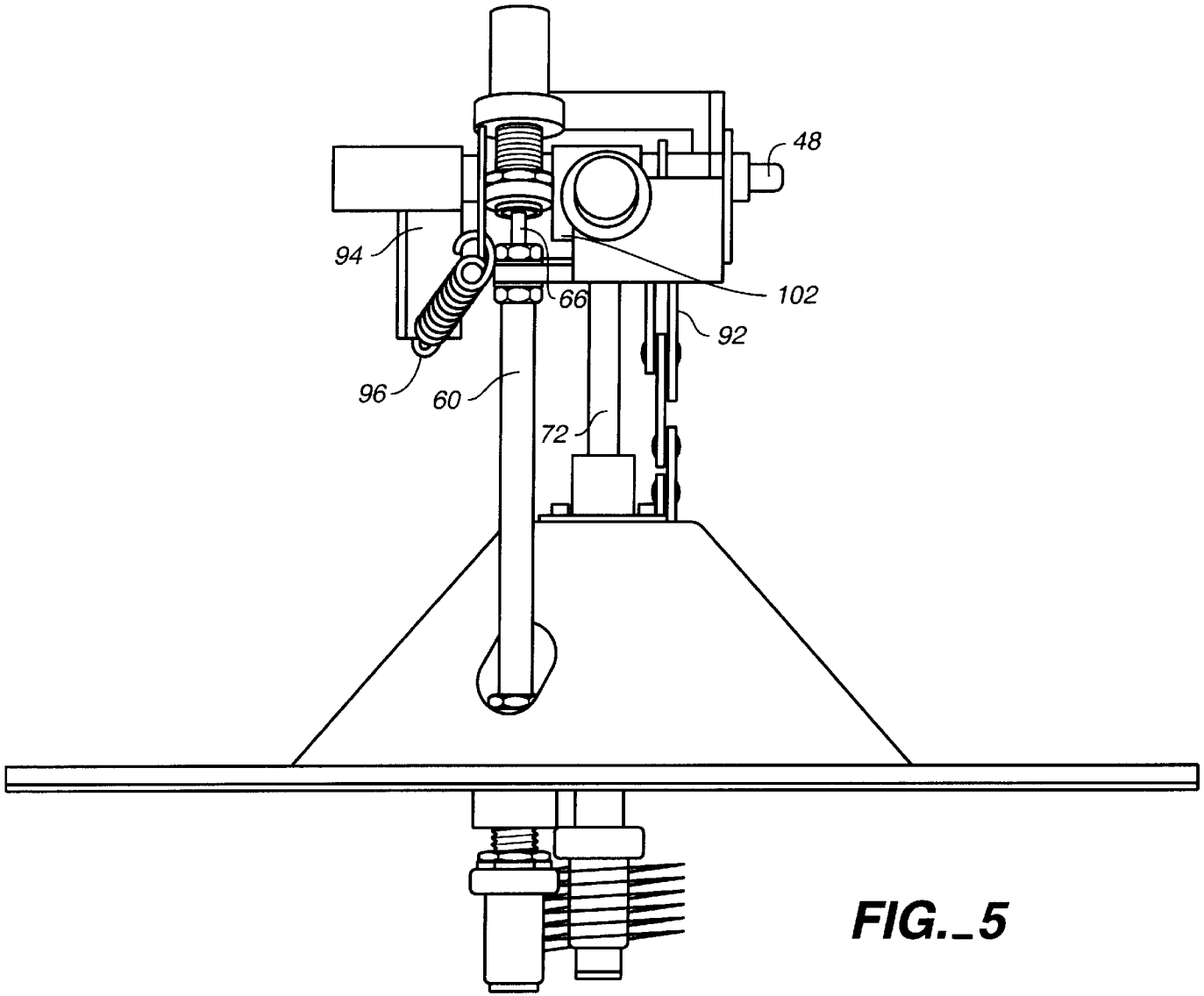
FIG. 5 is a front elevation view of the actuator assembly and flow control disc in the open configuration of the heating mode, as when supplying warm air to a cool room.

Referring now to FIG. 5, when heated air from the air supply duct 22 causes the second thermal actuator 52 to heat to a set temperature, e.g., 78° , the second thermal actuator reacts by extending its internal shaft to engage the already partially extended shaft of the third thermal actuator. FIG. 5 shows the actuator assembly in the configuration it would have in the heating mode while the room is yet cool.

Referring now to FIGS. 5 and 6, as the room temperature rises, the third thermal actuator 56 responds by extending its movable shaft 66 to push against the second thermal actuator 52 and thus rotate U-arm 48 clockwise. This depresses the uppermost arm of the lever assembly and thus raises flow control disc 86 according to temperature to vary the discharge opening and achieve and maintain the desired room temperature. Third thermal actuator works jointly with second thermal actuator to adjust and vary room air temperature in the heating mode only. It serves no function in the cooling mode. Additionally, third thermal actuator may be adjusted to respond at different temperatures with an easy turn of the actuator cap 62, either clockwise for less heat or counterclockwise for more heat.

In the cooling mode the supply air is provided below a set temperature, e.g., 68° . Below this set temperature, the movable shafts of the first and second thermal actuators are retracted. In the cooling mode, the fourth thermal actuator 70 varies the supply air. A rise in room air temperature will cause the movable shaft 74 of the fourth thermal actuator to engage second radial tab member 98 and rotate U-arm 48 up from lever assembly 92, thereby causing flow control disc 86 to descend and discharge opening 24 to widen, thus allowing more cool air to flow into the room. As the room cools, the movable shaft 74 of the fourth thermal actuator 70 retracts to cause the opposite effect. During heating, the fourth thermal actuator serves no function. During cooling, it functions independently of all of the other actuators to control supply air output.

As may be readily appreciated, all thermal actuators of the present invention may be preset at the factory and may be finely tuned either at the factory or in the room environment. This is accomplished, as described above with respect to the third thermal actuator, by turning the cap and integral threaded stem within its threaded mount. In the case of the first and second thermal actuators, this repositions the actuators within their respective brackets; with respect to the third and fourth thermal actuators, turning the cap and stem repositions the actuator within its respective isolator bushing. In all cases, such adjustments varies the range of the movable shaft.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims and equivalents.

What is claimed as invention is:

1. A thermally powered variable air volume diffuser that regulates air volume delivery in response to both air supply and room air temperature changes comprising:

a diffuser housing for connection to an air supply duct and having an supply air inlet and a diffused air outlet;

air flow outlet control means for varying the volume of air discharged from said diffused air outlet, said air flow outlet control means positioned relative to said diffuser housing so as to define an air discharge opening;

a first thermal actuator positioned to be exposed primarily to supply air and thermoactively responsive only when warm supply air heats said first thermal actuator above a preselected response threshold temperature, said first thermal actuator operatively connected to said air flow outlet control means so as to increase the size of the discharge opening as the temperature of said first thermal actuator rises above its response threshold temperature;

a second thermal actuator positioned to be exposed primarily to supply air and thermoactively responsive only when warm supply air heats said second thermal actuator to a temperature above a preselected response threshold temperature higher than the temperature at which said first thermal actuator responds, said second thermal actuator operatively connected to said air flow outlet control means so as to decrease the size of the discharge opening as the temperature of said second thermal actuator increases above its response threshold temperature;

a third thermal actuator positioned to be exposed primarily to room air and thermoactively responsive only when the temperature of said third thermal actuator rises above a preselected response threshold temperature, said third thermal actuator operatively connected to said air flow outlet control means so as to decrease the size of the air discharge opening as the temperature of said third thermal actuator rises above the preselected response threshold temperature of said third thermal actuator;

a fourth thermal actuator positioned to be exposed primarily to room air and thermoactively responsive only when heated above a preselected response threshold temperature when cool supply air has cooled said first, second, and third thermal actuators below their respective response temperature thresholds, said fourth thermal actuator operatively connected to said air flow outlet control means so as to increase the size of the discharge opening when heated above its response temperature threshold.

2. The thermally powered variable air volume diffuser of claim 1 wherein said air flow outlet control means is a flow control disc positioned relative to the underside of said diffuser housing so as to define an air discharge opening, said flow control disc having a circumferential brim portion and an interior conical damper portion.

3. The thermally powered variable air volume diffuser of claim 1, further comprising a thermal actuator assembly mounted within said diffuser housing and having means for mounting said first thermal actuator is mounted, means for mounting said second thermal actuator, means for mounting said third thermal actuator, and means for mounting said fourth thermal actuator.

4. The thermally powered variable air volume diffuser of claim 3 further including a chassis having a horizontal base portion, a first vertical section and a second vertical section, and wherein said means for mounting said first thermal actuator is a first bracket affixed to said chassis, and wherein said means for mounting said second thermal actuator is a second bracket affixed to said chassis, and wherein said means for mounting said third thermal actuator is a third bracket affixed to said chassis, and wherein said means for mounting said fourth thermal actuator is a fourth bracket affixed to said chassis.

5. The thermally powered variable air volume diffuser of claim 4 wherein said first thermal actuator has a first cap having a hollow cavity containing thermoactive material, and further has a first integral hollow threaded stem extending from said first cap and threadably mounted to said first bracket, and a first movable shaft surrounded by said first cylindrical stem; and wherein said second thermal actuator has a second cap having a hollow cavity containing thermoactive material, a second integral threaded stem threadably mounted to said second bracket, and a second movable shaft housed within said second threaded stem; and wherein said third thermal actuator has a third cap having a hollow cavity containing thermoactive material, a third integral threaded stem extending from said cap, a first isolator bushing into which said third threaded stem is threadably mounted, a first hollow cylindrical post extending upwardly from said first isolator bushing, and a third movable shaft the distal end of which extends beyond the end of said first hollow cylindrical post; and wherein said fourth thermal actuator has a fourth cap having a hollow cavity containing thermoactive material, a fourth integral threaded stem extending from said cap, a second isolator bushing into which said fourth threaded stem is threadably mounted, a second hollow cylindrical post extending upwardly from said second isolator bushing, and a fourth movable shaft the distal end of which extends beyond the end of said second hollow cylindrical post post.

6. The thermally powered variable air volume diffuser of claim 4 wherein said first thermal actuator has a first cap having a hollow cavity containing thermoactive material, and further has a first integral hollow threaded stem extending from said first cap and threadably mounted to said first bracket, and a first movable shaft surrounded by said first cylindrical stem; and wherein said second thermal actuator is a metal memory actuator mounted to said second bracket, said second thermal actuator actuator having a bimetalic helical coil spring movably connected to a second movable shaft; and wherein said third thermal actuator has a third cap having a hollow cavity containing thermoactive material, a third integral threaded stem extending from said cap, a first isolator bushing into which said third threaded stem is threadably mounted, a first hollow cylindrical post extending upwardly from said first isolator bushing, and a third movable shaft the distal end of which extends beyond the end of said first hollow cylindrical post; and wherein said fourth thermal actuator has a fourth cap having a hollow cavity containing thermoactive material, a fourth integral threaded stem extending from said cap, a second isolator bushing into which said fourth threaded stem is threadably mounted, a second hollow cylindrical post extending upwardly from said second isolator bushing, and a fourth movable shaft the distal end of which extends beyond the end of said second hollow cylindrical post post.

7. The thermally powered variable air volume diffuser of claim 6 wherein said helical coil spring of said second thermal actuator is a nickel-titanium alloy.

8. The thermally powered variable air volume diffuser of claim 5 wherein said fourth cap includes circumferential outwardly projecting radial fins to increase the thermal sensitivity and responsiveness of said fourth actuator.

9. The thermally powered variable air volume diffuser of claim 3 wherein said actuator assembly is mounted within said supply air inlet and further comprises:

a chassis with a horizontal base portion, a first vertical section, and a second vertical section, each of said first and second vertical sections having a transverse aperture;

a transverse axle rotatably mounted through the transverse apertures of said first and second vertical sections and extending outwardly from each of said first and second vertical sections;

a U-arm having apertures at each of its arms and pivotally mounted on said transverse axle, at least one of said arms cantilevering beyond said transverse axle to form said second bracket for mounting said second thermal actuator;

a lever assembly pivotally affixed to said transverse axle at one end and to said flow controller disc at the other end;

a first radial tab affixed to said transverse axle;

a first angular force means for imparting an angular force to the transverse axle;

a second radial tab member affixed to the approximate middle of said transverse axle and extending outwardly therefrom;

a third radial tab member affixed to the approximate middle of said transverse axle and extending outwardly therefrom;

a second angular force means interposed between said second radial tab member and said U-arm so as to impart an angular force to said second radial tab member and an opposing angular force to said U-arm.

10. The thermally powered variable air volume diffuser of claim 9 wherein said first angular force means is a helical extension spring.

11. The thermally powered variable air volume diffuser of claim 9 wherein said second angular force means is a right hand torsion spring biased against both said U-arm and said second radial tab member.

12. The thermally powered variable air volume diffuser of claim 9 wherein said second angular force means is a right hand torsion spring.

* * * * *